United States Patent [19]

Reyes

[11] Patent Number: 4,909,403

[45] **Date of Patent: * Mar. 20, 1990**

[54] MICROCLEAN PLASTIC BOTTLE AND HANDLE SYSTEM

[76] Inventor: Frank Reyes, 4044 W. Sweetwater Ave., Phoenix, Ariz. 85029

[ * ] Notice: The portion of the term of this patent subsequent to May 23, 2006 has been disclaimed.

[21] Appl. No.: 297,658

[22] Filed: Jan. 17, 1989

Related U.S. Application Data

[63] Continuation of Ser. No. 164,578, Mar. 7, 1988, Pat. No. 4,832,216, which is a continuation-in-part of Ser. No. 75,935, Jul. 20, 1987, abandoned.

[51] Int. Cl.[4] ..... B65D 23/00; B65D 23/10; B65D 1/02

[52] U.S. Cl. ..... 215/100 A; 220/94 R; 215/1 C

[58] Field of Search ..... 215/100 R, 100 A, 1 C; 220/94 R, 94 A; 294/27.1, 31.2, 33

[56] References Cited

U.S. PATENT DOCUMENTS

| | | | |
|---|---|---|---|
| D. 184,315 | 1/1959 | Jennings et al. | 215/100 A X |
| D. 187,500 | 3/1960 | Jennings et al. | 215/100 A X |
| 2,982,434 | 5/1961 | Hidding | 215/100 |
| 3,000,527 | 9/1961 | Jennings et al. | 215/100 A |
| 3,036,371 | 5/1962 | Gray et al. | 215/100 A |
| 3,043,461 | 7/1962 | Glassco | 215/1 C |
| 3,100,576 | 8/1963 | Frank | 215/1 C |
| 3,311,252 | 3/1967 | Swartwood et al. | 294/31.2 X |
| 3,404,795 | 10/1968 | Kemp | 215/100 A |
| 3,463,536 | 8/1969 | Updegraff et al. | 394/31.2 |
| 3,478,913 | 11/1969 | Kemp | 215/100 A |
| 4,368,826 | 1/1983 | Thompson | 215/100 A |
| 4,438,856 | 3/1984 | Chang | 215/1 C |
| 4,582,215 | 4/1986 | Barrash | 220/94 R |

FOREIGN PATENT DOCUMENTS

| | | | |
|---|---|---|---|
| 2322478 | 11/1974 | Fed. Rep. of Germany | 215/100 A |
| 3530015 | 2/1987 | Fed. Rep. of Germany | 294/31.2 |
| 2157257 | 10/1985 | United Kingdom | 294/31.2 |

*Primary Examiner*—Sue A. Weaver

*Attorney, Agent, or Firm*—Victor Flores; Harry M. Weiss

[57] ABSTRACT

A microclean plastic bottle and handle system in which the bottle and handle are separately fabricated and joined at an appropriate time during the use of the bottle is disclosed. The bottle has an internal surface transverse cross section which is circular at each increment of its height between the bottle bottom and the top opening in order to minimize the possibility of creating contaminant-receiving crevices. The contours within the bottle are such that the interior is devoid of any inside corner exceeding about 60 degrees to further limit the potential for forming tiny crevices capable of containing microparticles of contaminating matter which are not readily removed by an interior washing process. An integral shoulder ring extends circumferentially about the bottle neck to serve as a detent for securely affixing the subsequently emplaced handle to the bottle. The handle includes a generally cylindrical bottle neck engaging portion and a yoke portion having three sides. The first and third sides each join the second side at an acute angle and converge toward one another and toward the neck engaging portion which they join more or less tangentially to provide a unitary structure.

7 Claims, 1 Drawing Sheet

MICROCLEAN PLASTIC BOTTLE AND HANDLE SYSTEM

This is a continuation of application Ser. No. 164,578 filed 03-07-88 now U.S. Pat. No 4,832,216 which is a continuation-in-part of application Ser. No. 07/075,935 filed 07-20-87 now abandoned.

FIELD OF THE INVENTION

This invention relates to the container arts and, more particularly, to containers especially adapted to transport and dispense ultrapure chemicals such as those employed in the semi-conductor industry.

BACKGROUND OF THE INVENTION

There are numerous applications in modern industry for the use of ultrapure chemicals. One particularly crucial application is in the semiconductor industry in which, in seeking both quantity and quality of production, strict clean room techniques are employed in conjunction with the use of chemicals whose purity is critical. As a result, there has been a long standing need, never adequately addressed in the prior art, for microclean containers for receiving, transporting, storing and dispensing such ultrapure chemicals. For safety purposes, it is desirable that such containers be fabricated from plastic rather than glass in order to avoid breakage if the container should be dropped. Further, plastic containers are less costly and more readily disposed of after use. However, a notoriously well-known drawback to the use of plastic bottles has been the difficulty of getting the interior of the bottle itself sufficiently microclean as to avoid contamination of the chemical which is to be contained. Typically, the handle for such plastic bottles has been molded into the bottle during the molding process, but these handles, which are hollow and open into the bottle interior, are virtually inaccessible to admit of proper cleaning such that it has been very difficult to remove microsize particles from them as well as from other crevices which might be present within the bottle. However, those skilled in the art will appreciate that a reliable, sturdy handle must be provided to facilitate manually dispensing the chemical contained within the bottle. Another disadvantage of the typical prior art handle has been the fact that its position with respect to the balance of a bottle from which a chemical is being poured is such that one hand is close to the pouring spout and thus exposed to the chemical which may well be dangerous upon contact. Further, even if the chemical is not dangerous, it may well be hopelessly contaminated by any contact whatever with the hand, gloves or any part of a person's body or apparel.

Thus, those skilled in the art are well aware that it would be highly desirable to provide a strong plastic bottle which can be rendered and maintained microclean in conjunction with a strong handle which is especially configured to promote a safe and non-contaminating dispensing operation. It is to these ends that my invention is directed.

OBJECTS OF THE INVENTION

It is therefore a broad object of my invention to provide an improved microclean bottle for storing, transporting and dispensing ultrapure fluids.

It is another object of my invention to provide such a bottle which is provided with a specially configured handle which can be integrated with the bottle in such a manner that dispensing the contained fluid may be carried out safely and in a non-contaminating manner.

It is yet another object of my invention to provide such a bottle and accompanying handle which are strong and durable, but which are nonetheless economical to fabricate in a straightforward and conventional molding process.

SUMMARY OF THE INVENTION

Briefly, these and other objects of my invention are achieved by a microclean plastic bottle and handle system in which the bottle and handle ar separately fabricated and joined at an appropriate time during the us of the bottle. The plastic bottle includes a neck region terminating in a top opening for receiving and dispensing the contained fluid. A side wall having exterior and interior surfaces joins the neck region and curves outwardly to a cylindrical main body portion coaxial with the neck region. The bottle has an internal surface transverse cross section which is circular at each increment of its height between the bottle bottom and the top opening in order to minimize the possibility of creating contaminant-receiving crevices. Preferably, the contours within the bottle are such that the interior is devoid of any inside corner exceeding about 60 degrees to further limit the potential for forming tiny crevices capable of containing microparticles of contaminating matter which are not readily removed by an interior washing process.

An integral shoulder ring extends circumferentially about the neck region to serve as a detent for securely affixing the subsequently emplaced handle to the bottle. The handle component includes a generally cylindrical bottle neck engaging portion and a yoke portion which includes first, second and third sides. The first and third sides each join the second side at an acute angle and converge toward one another and toward the neck engaging portion which they join more or less tangentially to provide a unitary structure. When the handle is attached, the second side is oriented at right angles with respect to the axis of the bottle structure and offset from the bottle axis on the order of one and one-half inches (for a typical one gallon bottle) which forces a person using the bottle to pour the contents with two hands, one supporting the bottle from the handle and the other tipping the bottle from the bottom end and away from the dispensing spout.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figure 1:
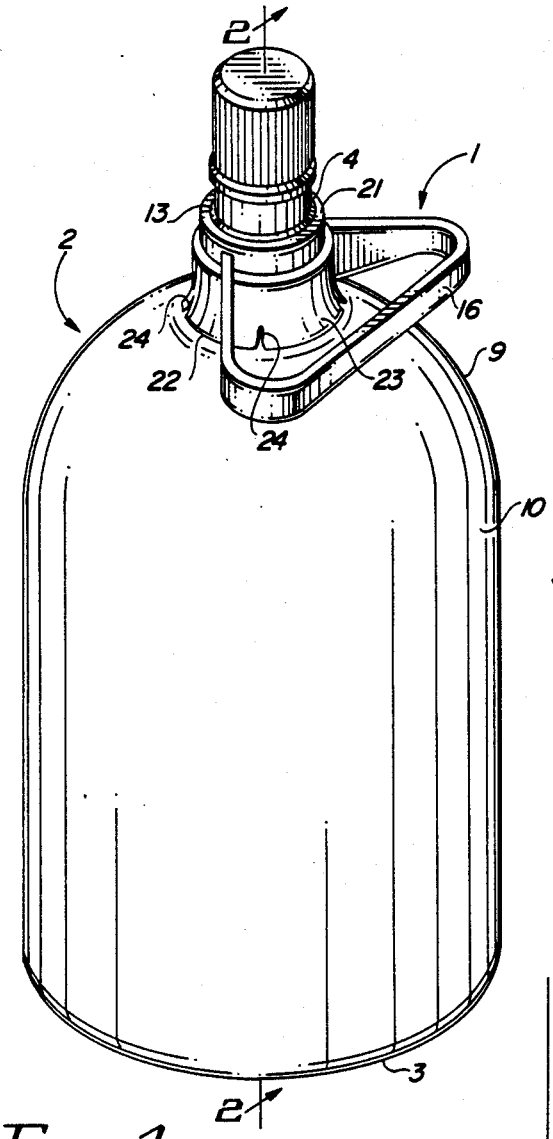
FIG. 1 is a perspective view of the subject microclean plastic bottle and handle system in which the separately fabricated handle is illustrated after it has been coupled permanently to the bottle.
Figure 2:
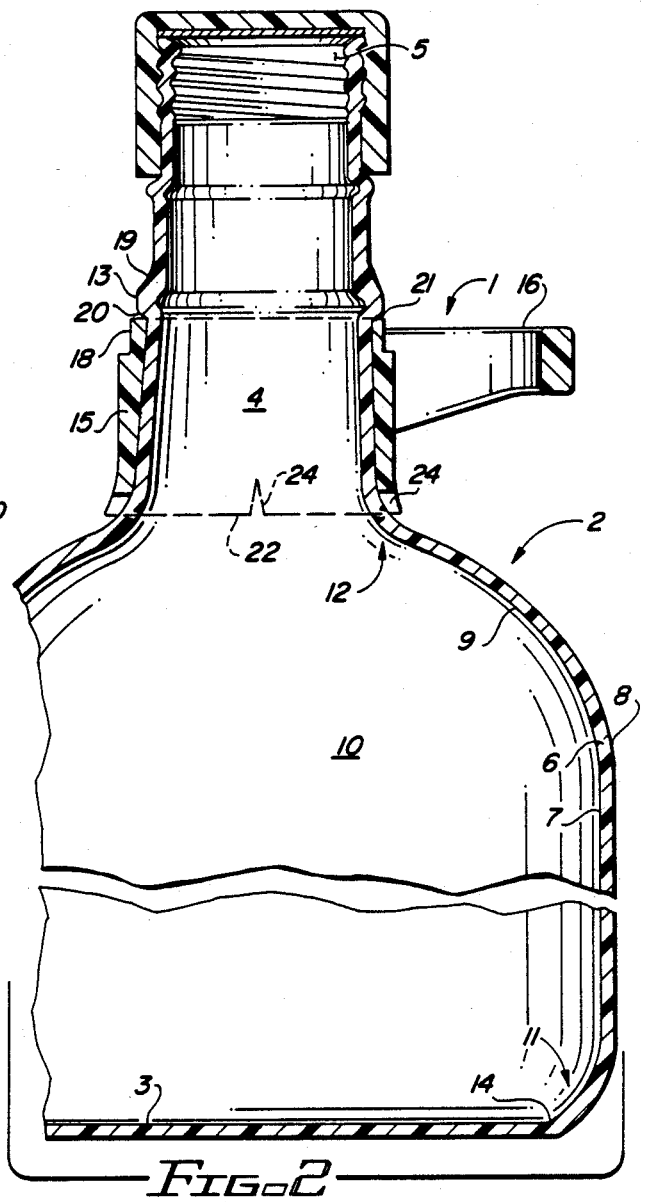
FIG. 2 is an enlarged cross sectional view taken along the lines 2—2 of FIG. 1 and showing a number of detail features of the system which are not readily apparent and which contribute to the system performance.

Referring now to FIG. 1, there is shown the plastic bottle and handle system as it appears after the handle 1 has been coupled to the bottle 2. Referring also to FIG. 2, the plastic bottle 2 extends from a bottom 3 to a top opening 5 in a neck region 4. A side wall 6, having interior 7 and exterior 8 surfaces, joins the neck region 4 and curves outwardly through the intermediate region 9 to a cylindrical main body portion 10 which is coaxial with the neck region 4. The bottle 2 is particularly characterized in that its internal surface, from the bottom 3 to the top opening 5, is circular at each cross sectional increment of its height in a plane disposed perpendicular to the bottle axis. Additionally, it will be noted that the inside corner region 11 and the outside corner region 12 of the interior surface are each gradual rather than abrupt. Preferably, the most abrupt point 14 at which the inside corner region 11 joins the bottom 3 should be no more than about 60 degrees and should have a smooth, albeit small, radius of curvature to prevent the inadvertent formation of microsizeparticle-receiving crevices and niches.

Figure 3:
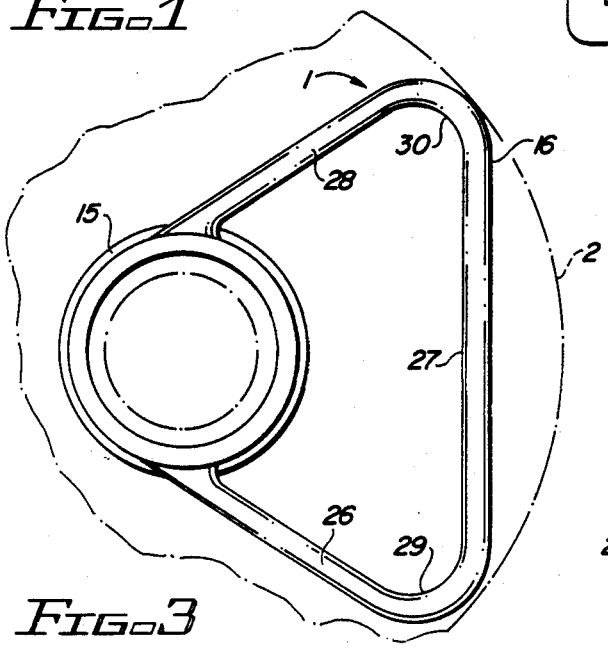
FIG. 3 is a top view of the handle component particularly illustrating the relationship of the handle to the bottle axis.

Referring to FIG. 3 as well as continuing to refer to FIGS. 1 and 2, the handle 1 is a unitary separate plastic component adapted to be introduced over the bottle neck region 4 and snapped past a circular shoulder ring 13 to be thereafter permanently retained on the bottle by the shoulder ring. The handle 1 includes a generally cylindrical neck engaging portion 15 and a graspable yoke portion 16 which joins the neck engaging portion. As best shown in FIG. 2, the neck engaging portion 15 has a reduced wall thickness region 18 which facilitates assembly of the handle to the bottle as will be described below. The shoulder ring 13 is provided with sloped upper 19 and more abruptly sloped lower 20 shoulder surfaces which also facilitate assembly of the handle 1 and its subsequent retention on the bottle 2. The height of the neck engaging portion 15, which extends from an upper shoulder 21 to a lower edge 22, slightly exceeds the distance between the lower shoulder surface 20 of the shoulder ring 13 and the exterior surface 8 of the side wall 6 proximate the outside corner region 12 when unstressed. However, a force fit is obtained by virtue of the flexible nature of the plastic material from which the handle 1 is fabricated, the tapered region 23 of diminished thickness leading to the thin edge 22 and the provision of a plurality of longitudinal slits 24 which are circumferentially distributed about the bottle neck engaging portion 15 and extend upwardly from the lower edge 22.

A minimum inside diameter of the bottle neck engaging portion 15, when in its unstressed state, is slightly less than the outside diameter of the shoulder ring 13. Thus, from the foregoing, it will be appreciated that the neck engaging portion 15 of the handle 1 may be introduced over the neck region 4 of the bottle 1 and forced downwardly over the shoulder ring 13 until the lower edge 22 abuts the exterior surface 8 of the side wall 6 at the outside corner region 12. Then, outward flexure of the tapered region 23 permits the neck engaging portion 15 to be further forced completely past the shoulder ring 13 until the reduced thickness region 18 resiliently snaps beneath the lower shoulder surface 20 to place the neck engaging portion 15 in compression and securely provide its permanent retention on the bottle neck. As previously noted, the upper shoulder surface 19 is substantially more shallow in slope than the lower shoulder surface 20 since its principal office is to promote the process of forcing the bottle neck engaging portion 15 past the shoulder ring 13.

As best shown in FIG. 3, the graspable yoke portion 16 of the handle 1 includes a first side 26 which joins at its first end to a first end of a second side 27 at a junction region 29. Similarly, a third side 28 has a first end which joins the second end of the second side 27 at the junction region 30. The sides 26, 28 each form an acute angle with the second side 27 and converge toward their respective second ends which join the neck engaging portion 15 more or less tangentially as shown. Thus, the second side 27 of the yoke portion 16 lies generally perpendicular to and offset from the axis of the neck engaging portion 15 and hence to the bottle 2 when the handle 1 has been secured to the bottle as previously described. For a gallon bottle, it has been found that an offset of the second side 27 of the yoke 16 should be about one and one-half inches from the bottle axis.

Figure 4:
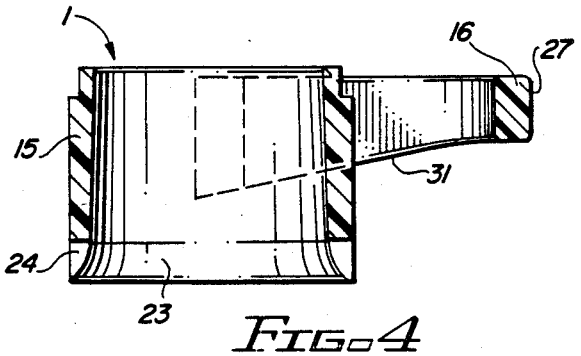
FIG. 4 is a cross sectional view of the handle assembly taken prior to its being coupled to a bottle.

It will be understood that the handle 1, while somewhat elastic by virtue of its plastic material is nonetheless a rigid structure in use. Thus, the minimum height of the side walls 26, 27, 28 may be on the order of one-half inch and their thickness three-eighths inch or more. Further, as indicated at 31 in FIG. 4, it is desirable to increase the height of the first 26 and third 28 sides as they extend from the second side 27 toward their respective junctions with the bottle neck engaging portion 15.

The materials from which the handle 1 and, especially, the bottle 2 should be appropriate for their functions. The bottle must be fabricated from a tough inert material which molds cleanly and without residue. A good material for this application is seven melt, 960 high density polyethylene resin or substitute which can be blow molded in a standard injection mold employing a standard injection blow molding machine. It has been found very desirable to use virgin material (i.e., allowing no reground material in the mix) since reground material tends to flake on the bottle inside and thus itself becomes a contaminant.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A microclean plastic bottle and handle system comprising:

(a) a plastic bottle having a bottom, a neck region terminating in a top opening and a sidewall have interior and exterior surface, said sidewall joining said neck region at a corner region and curved outwardly therefrom to a cylindrical main body portion coaxial with said neck region, said plastic bottle:

(i) having an internal surface transverse cross section which is circular at each increment of its height between said bottom to said top opening; and (ii) having an integral circular shoulder ring extending circumferentially about said neck region and outwardly therefrom, said shoulder ring having upper and lower shoulder surfaces; and (b) a unitary separate plastic handle, said handle having a generally cylindrical bottle neck engaging portion having a minimum inside diameter which is slightly less than an outside diameter of said shoulder ring to facilitate being introduced over said bottle neck region and snapped past said shoulder ring to be thereafter permanently retained on said bottle, said neck engaging portion having a height which extends from an upper shoulder to a lower edge and which, in its unstressed state, exceeds the distance between said lower shoulder surface of said shoulder ring and said exterior surface of said sidewall proximate said corner region.

2. The microclean plastic bottle and handle system of claim 1 in which said handle further includes having a graspable yoke portion.

3. The microclean plastic bottle and handle system of claim 2 in which said neck engaging portion further includes having a plurality of circumferentially distributed longitudinal slits extending upwardly from said lower edge to provide increased radial outward flexibility thereof.

4. The microclean plastic bottle and handle system of claim 2 in which said graspable yoke portion:

(a) includes having a first, second and third sides, each said sides having first and second ends, (i) said first end of said first side joining said first end of said second side and forming an acute angle therewith, (ii) said first end of said third side joining said second end of said second side and forming an acute angle therewith, (iii) said first and third sides converging toward said respective second ends thereof; and (iv) said second ends of said first and third sides joining said neck engaging portion and said second side being perpendicular to and rigidly offset by a predetermined distance from an axis of said neck engaging portion and to a vertical axis of said bottle.

5. A microclean plastic bottle and handle system comprising:

(a) a plastic bottle having a bottom, a neck region terminating in a top opening and a sidewall having interior and exterior surface, said sidewall joining said neck region at a corner region, said plastic bottle having an integral circular shoulder ring extending circumferentially about said neck region and outwardly therefrom, said shoulder ring having upper and lower shoulder surfaces; and (b) a unitary separate plastic handle, said handle having a generally cylindrical bottle neck engaging portion for being introduced over said bottle neck region and snapped past said shoulder ring to be thereafter permanently retained on said bottle, said handle also having a graspable yoke portion, said neck engaging portion having a minimum inside diameter which is slightly less than the outside diameter of said shoulder ring such that said neck engaging portion can be forced past said shoulder ring as a consequence of the natural resilience of the plastic material, said cylindrical bottle neck engaging portion also having a height which extends from an upper shoulder to a lower edge and which, in its unstressed state, exceeds the distance between said lower shoulder surface of said shoulder ring and said exterior surface of said sidewall proximate said corner region.

6. The microclean plastic bottle and handle system of claim 1 in which:

said plastic bottle having an internal surface transverse cross section which is circular at each increment of its height between said bottom to said top opening.

7. The microclean plastic bottle and handle system of claim 5 in which said graspable yoke portion:

(a) includes having a first, second and third sides, each said sides having first and second ends, (i) said first end of said first side joining said first end of said second side and forming an acute angle therewith, (ii) said first end of said third side joining said second end of which second side and forming an acute angle therewith, (iii) said first and third sides converging toward said respective second ends thereof; and (iv) said second ends of said first and third sides joining said neck engaging portion and said second side being perpendicular to and rigidly offset by a predetermined distance from an axis of said neck engaging portion and to a vertical axis of said bottle.

* * * * *